US006615777B2

(12) United States Patent
Grau

(10) Patent No.: US 6,615,777 B2
(45) Date of Patent: Sep. 9, 2003

(54) ELECTRICALLY ROTATABLE SHAFT

(75) Inventor: Ulrich Grau, Emskirchen (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 10/132,027

(22) Filed: Apr. 25, 2002

(65) Prior Publication Data

US 2002/0157626 A1 Oct. 31, 2002

(30) Foreign Application Priority Data

Apr. 26, 2001 (DE) ..... 101 20 450

(51) Int. Cl.[7] ..... F01L 1/34

(52) U.S. Cl. ..... 123/90.16; 123/90.15; 74/89.23; 74/54

(58) Field of Search ..... 123/90.15, 90.16; 74/89.23, 89.34, 567, 568 R, 54

(56) References Cited

U.S. PATENT DOCUMENTS

| | | | | |
|---|---|---|---|---|
| 3,698,673 A | * | 10/1972 | Olsen | 248/421 |
| 4,100,850 A | * | 7/1978 | Wolbrink et al. | 100/287 |
| 4,187,730 A | * | 2/1980 | Delorme | 74/54 |
| 4,527,446 A | * | 7/1985 | Borodin | 74/828 |
| 4,912,994 A | * | 4/1990 | Roberts | 74/96 |
| 5,444,880 A | * | 8/1995 | Weismiller et al. | 5/424 |

FOREIGN PATENT DOCUMENTS

| | | |
|---|---|---|
| DE | 118157 | 2/1976 |
| DE | 2539510 | 4/1979 |
| DE | 3923927 | 1/1991 |
| DE | 19832382 | 1/2000 |
| DE | 20020112 | 3/2001 |

OTHER PUBLICATIONS

JP 2000073719 A, Mar. 7, 2000, Patent Abracts of Japan.

* cited by examiner

*Primary Examiner*—Thomas Denion
*Assistant Examiner*—Jaime Corrigan
(74) *Attorney, Agent, or Firm*—Muserlian, Lucas and Mercanti

(57) ABSTRACT

The invention concerns an electrically rotatable shaft, and more particularly, an adjusting shaft (1) of a fully variable mechanical valve train of an internal combustion engine, said shaft comprising an adjusting cam (2). The rapid and exact rotation of the adjusting shaft (1) that is required for the fully variable valve train is achieved by the fact that the valve train comprises an actuator (3) that comprises an adjusting lever (4) connected rotationally fast to the adjusting shaft (1), and the free end of the adjusting lever is articulated through a forked lever (5) on a screw nut ((8) of a screw-and-nut drive (6) that is driven by an electromotor (7).

7 Claims, 1 Drawing Sheet

ELECTRICALLY ROTATABLE SHAFT

FIELD OF THE INVENTION

The invention concerns an electrically rotatable adjusting shaft of a fully variable mechanical valve train of an internal combustion engine, said shaft comprising an adjusting cam.

BACKGROUND OF THE INVENTION

The advantages of a throttle-free load regulation of Otto engines by means of fully variable inlet valve controls are known. By the omission of throttles, it is possible to exclude throttling losses that otherwise occur over a large range of load conditions of the internal combustion engine. This has a positive effect on fuel consumption and on the engine torque.

In variable mechanical valve trains, the stroke adjustment of the inlet gas exchange valves should be as spontaneous and exact as possible and should be effected at a high speed of adjustment. The adjusting mechanism is usually an adjusting shaft having locking curves or eccentrics.

Depending on the system used and the structural configuration, considerable moments of actuation are required for setting the desired valve stroke and the corresponding rotation of the adjusting shaft. These moments of actuation result from the reaction forces of the valve train that act on the adjusting shaft. For adjustment in a direction for obtaining a larger stroke, the adjusting shaft must be moved against the reaction forces of the valve train and, due to the oscillating movement of the gas exchange valves, this is accompanied by strongly pulsating torques.

To achieve an optimum operation of the valve train, a lash-free and extremely rigid support of the moments of the adjusting shaft is required. This support governs the positioning precision and the operation of a fully variable valve train as also the adjustability of an internal combustion engine equipped with such a system. The time for adjusting from a minimum to a maximum stroke should be less than 300 milliseconds.

The power requirement of the electric drive of the adjusting shaft should not put a too heavy load on the vehicle network. Therefore, small, high-speed electromotors combined with gearboxes having high transmission ratios are desirable.

One conceivable solution is to use worm drives. These, however, have a poor efficiency and are susceptible to wear that in its turn causes lash. In addition, worm drives have a limited range of transmission. It is also conceivable to use hydraulic adjusters similar to camshaft adjusters configured as vane-type adjusting devices or as coarse-thread adjusters. Their operation, however, depends to a large extent on the lubricating oil pressure which, in its turn, depends on the temperature of the lubricating oil and on the engine being actually in operation. Their adjusting dynamics and rigidity are low.

A further solution may be rotary drives but these have a low efficiency and a great amount of rotational lash.

OBJECTS OF THE INVENTION

It is an object of the invention to provide a compact actuator for the adjusting shaft of a fully variable mechanical valve train of an internal combustion engine, which actuator should have the highest possible rigidity and possess characteristics of low lash and low friction.

This and other objects and advantages of the invention will become obvious from the following detailed description.

SUMMARY OF THE INVENTION

The invention achieves the above objects by the fact that an actuator for rotating the adjusting shaft comprises an adjusting lever that is connected rotationally fast to the adjusting shaft, and a free end of the adjusting lever is articulated through a forked lever on the screw nut of a screw-and-nut drive that is driven by an electromotor. The connection of the adjusting lever to the forked lever as well as that of the forked lever and the screw nut to the threaded screw are substantially free of lash and very rigid. This results in a high positioning precision and, due to low frictional losses, a short adjusting time with a relatively low torque of the electromotor and insignificant load on the vehicle network.

In the present embodiment of the screw-and-nut drive, the electromotor drives the threaded screw but a solution in which a screw nut is driven is also feasible.

In an advantageous embodiment of the invention, the forked lever and the screw nut comprise two further bearing pins with which they are articulated on each other, said further bearing pins having a common axis that extends through the center and the longitudinal axis of the screw nut.

The two articulated joints and their symmetric arrangement permit the forked lever and the screw nut to be loaded symmetrically with a load that is free of bending moments. A further advantage is that the forked lever in combination with the adjusting lever permits an optimal fixing of the screw nut against rotation.

Advantageously, an electromotor shaft and the threaded screw are made together in one piece. As a result, no coupling is required between the electromotor and the threaded screw and a simple, compact and very rigid actuator is obtained.

Due to the lateral forces that are exerted by the screw nut on the threaded screw, it is necessary that, in addition to the bearings of the electromotor shaft, the threaded screw comprise on its free end, a support bearing.

One of the bearings is configured as a fixed bearing in the form of a deep groove or an angular contact ball bearing, while the movable bearing is configured preferably as a needle roller bearing.

Advantageously, the screw drive is preferably configured as a ball screw drive with pre-stress and a ball deflection that is arranged on the side of the screw nut that is free of shearing forces. Due to the low friction obtained with the balls, the load on the vehicle network is only insignificant despite high speeds of adjustment, and it is possible to use electromotors having a relatively low torque.

The low lash of the actuator resulting from the pre-stress is a basic requirement for a precise positioning of the adjusting shaft and, thus also, for an exact setting of the valve stroke.

Pre-stressing is achieved by an overdimensioning of the balls. It is also possible to use rollers in place of the balls.

The ball deflection arranged on the side of the screw nut that is free of shearing forces effects a trouble-free return of the balls.

Due to the fact that the transmission ratio between the electromotor and the adjusting shaft is determined by the lengths of the adjusting lever and the forked lever as also by the pitch and the screwed position of the threaded screw, a high transmission ratio can be realized in a single stage. The efficiency values that can thus be achieved are distinctly higher than with multi-stage rotary drives or with worm drives. As desired, the moment of adjustment increases largely toward the end of the adjustment due to the lever geometry, while the torque of the electromotor, at the same time, approaches zero.

A further advantage of the invention is that the actuator can be installed in any longitudinal and any angular position on the adjusting shaft. In this way, the position of the actuator can be optimally adapted to the conditions of installation of the internal combustion engine.

Further features of the invention are disclosed in the following description and in the appended drawings which show a schematic representation of one example of embodiment of the invention.

DETAILED DESCRIPTION OF THE DRAWINGS

Figure 1:
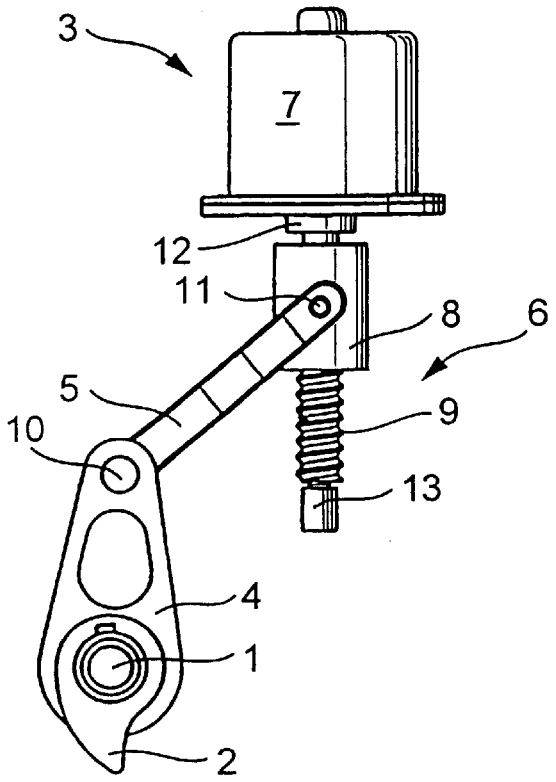
FIG. 1 is a perspective view of an adjusting shaft assembled with an actuator.
Figure 2:
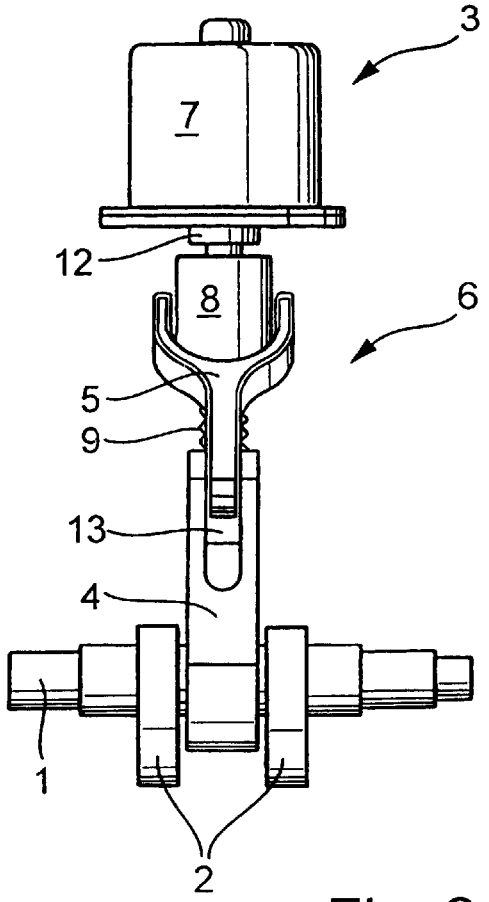
FIG. 2 is a side view of the actuator in crosswise position to the adjusting shaft.

FIGS. 1 and 2 show an adjusting shaft 1 with an adjusting cam 2 for a fully variable mechanical valve train, not shown, of an Otto engine, and an actuator 3 for the adjusting shaft 1.

The actuator comprises an adjusting lever 4, a forked lever 5, a screw-and-nut drive 6 and an electromotor 7. The screw-and-nut drive 6 is made up of a screw nut 8 and a threaded screw 9 guided therein.

The adjusting lever 4 is connected rotationally fast to the adjusting shaft 1. The forked end of the adjusting lever 4 is connected through a bearing pin 10 to the forked lever 5.

The forked lever 5 and the screw nut 8 comprise two further bearing pins 11 that articulate the forked lever 5 and the screw nut 8 on each other and have a common axis that extends through the center and through the longitudinal axis of the screw nut 8. In this way, the screw nut 8 is secured against rotation.

The threaded screw 9 and an electromotor shaft 12 are made together in one piece. Therefore, a coupling between the threaded screw 9 and the electromotor shaft 12, otherwise required, can be omitted, so that an actuator 3 with a compact, rigid and simple structure is obtained.

The electromotor shaft 12 comprises two bearings, in addition to which, the threaded screw 9 comprises a support bearing 13. This support bearing 13 is required because of the high shearing forces transmitted by the forked lever 5 through the screw nut 8 to the threaded screw 9. All three bearings are arranged on the cylinder head, and one of these bearings is configured as a fixed bearing.

To minimize lash in the mechanism, the screw-and-nut drive can be configured with pre-stress which can be achieved, for example, with overdimensioned rolling elements. The screw-and-nut drive may be a ball screw drive or a roller screw drive. Ball deflections and, in the case of roller screw drives, any existing restoring devices should be disposed on the side of screw nut that is free of lateral forces.

The low friction permits the use of low torque electromotors that load the vehicle network only insignificantly.

The transmission ratio between the electromotor 7 and the adjusting shaft 1 is determined by the lengths of the adjusting lever 4 and the forked lever 5 as also by the pitch and the screwed position of the threaded screw 9. With these relatively simple and therefore inexpensive mechanical components, a high ratio of transmission can be obtained between the electromotor 7 and the adjusting shaft 1. This is particularly true for the final phase of the adjusting movement in which the forked lever 5 is more or less perpendicular to the threaded screw 9 and effects a high transmission ratio and simultaneously requires a low driving moment.

The actuator 3 can installed in any longitudinal and any angular position on the adjusting shaft 1 and thus be optimally adapted to the conditions of installation of the internal combustion engine.

The actuator of the invention functions as follows:

The threaded screw 9 that is directly driven by the electromotor 7 in its turn drives the screw nut 8 that is secured against rotation by the forked lever 5 and the adjusting lever 4. As a result, the rotary movement of the threaded screw 9 is converted into a translational movement of the screw nut 8 and this translational movement is converted by the forked lever 5 and the adjusting lever 4 into a rotary movement of the adjusting shaft 1. The adjusting force reaches its maximum in the region of the bottom dead center of the threaded nut 8 while the driving moment of the threaded nut 8 falls to zero.

The actuator of the invention distinguishes itself by a simple, rigid and compact structure. Due to low lash, it achieves a high positioning precision and due to low friction, a high adjusting speed with low load on the vehicle network.

What is claimed is:

1. An electrically rotatable adjusting shaft of a fully variable mechanical valve train of an internal combustion engine, said shaft comprising an adjusting cam, wherein an actuator for rotating the adjusting shaft comprises an adjusting lever that is connected rotationally fast to the adjusting shaft, and a free end of the adjusting lever is articulated through a forked lever on a screw nut of a screw-and-nut drive that is driven by an electromotor, the forked lever and the screw nut comprise two further bearing pins with which they are articulated on each other, said further bearing pins having a common axis that extends through a center and through a longitudinal axis of the screw nut and an electromotor shaft and the threaded screw are made together in one piece.

2. An electrically driven shaft of claim 1, wherein, in addition to bearings for the electromotor shaft, a support bearing is arranged on a free end of the threaded screw.

3. An electrically driven shaft of claim 2, wherein one of the bearings is configured as a fixed bearing.

4. An electrically driven shaft of claim 3, wherein the fixed bearing is configured as one of a deep groove ball bearing, an angular contact ball bearing and a four point bearing, while movable bearings are configured as needle roller bearings.

5. An electrically driven shaft of claim 4, wherein the screw-and-nut drive is configured as a ball screw drive with pre-stress and a ball deflection that is arranged on a side of the screw nut that is free of shearing forces.

6. An electrically driven shaft of claim 5, wherein a transmission ratio between the electromotor and the adjusting shaft is determined by lengths of the adjusting lever and the forked lever as also by a pitch and a screwed position of the threaded screw.

7. An electrically driven shaft of claim 6, wherein the actuator can be installed in any longitudinal and any angular position on the adjusting shaft.

* * * * *